United States Patent [19]

Boyd

[11] Patent Number: 4,838,324

[45] Date of Patent: Jun. 13, 1989

[54] BEVERAGE CONTAINER PRESSURIZER

[75] Inventor: Cecil Boyd, Neosho, Mo.

[73] Assignee: Judith Brock, Neosho, Mo. ; a part interest

[21] Appl. No.: 102,349

[22] Filed: Sep. 29, 1987

[51] Int. Cl.[4] ..... B65B 31/00

[52] U.S. Cl. ..... 141/64; 251/149.7; 222/387; 222/152

[58] Field of Search ..... 222/129.1, 325, 386, 222/387, 152, 192; 141/46, 27, 63, 64; 261/DIG. 7, 121.1, 119.1; 254/149.6, 149.7; 99/323.1, 323.2

[56] References Cited

U.S. PATENT DOCUMENTS

| | | | |
|---|---|---|---|
| 1,513,687 | 10/1924 | Bacon | 251/149.7 |
| 2,131,740 | 10/1938 | Kappelman | 251/149.7 |
| 2,757,843 | 8/1956 | Smith | 141/64 |
| 3,035,617 | 5/1962 | Breitenstein | 251/149.7 |
| 3,853,222 | 12/1974 | Helms | 206/315 |
| 4,033,091 | 7/1977 | Saponara | 53/88 |
| 4,287,819 | 9/1981 | Amerit | 99/472 |
| 4,497,348 | 2/1985 | Sedam | 261/DIG. 7 |
| 4,524,877 | 6/1985 | Saxby | 215/228 |

FOREIGN PATENT DOCUMENTS

| | | | |
|---|---|---|---|
| 2425031 | 3/1974 | Fed. Rep. of Germany | 141/27 |
| 2175681 | 12/1986 | United Kingdom | 141/63 |

*Primary Examiner*—Kevin P. Shaver
*Assistant Examiner*—Kenneth Noland
*Attorney, Agent, or Firm*—Fleit, Jacobson, Cohn & Price

[57] ABSTRACT

A beverage container pressurizer and more particularly to a screw threaded cap that replaces the screw threaded cap normally provided on large beverage containers and a manually operated reciprocating piston-type pump sealingly and releaseably connected with the screw threaded cap for pressurizing the beverage container to keep the carbonation suspended in a liquid state for sustaining the quality of a carbonated beverage for an extended life before "going flat". The replacement cap includes a valve assembly which permits entry of pressurized air from the pump but prevents egress of pressurized air from the container when the pump is removed. This arrangement enables a single pump to pressurize a number of beverage containers since the pump is separable from the replacement screw threaded cap which remains with the beverage container until all of the beverage has been consumed.

3 Claims, 1 Drawing Sheet

BEVERAGE CONTAINER PRESSURIZER

BACKGROUND OF THE INVENTION

1. Field of the Invention

The present invention generally relates to a beverage container pressurizer and more particularly to a screw threaded cap that replaces the screw threaded cap normally provided on large beverage containers and a manually operated reciprocating piston-type pump sealingly and releaseably connected with the screw threaded cap for pressurizing the beverage container to keep the carbonation suspended in a liquid state for sustaining the quality of a carbonated beverage for an extended life before "going flat". The replacement cap includes a valve assembly which permits entry of pressurized air from the pump but prevents egress of pressurized air from the container when the pump is removed. This arrangement enables a single pump to pressurize a number of beverage containers since the pump is separable from the replacement screw threaded cap which remains with the beverage container until all of the beverage has been consumed.

INFORMATION DISCLOSURE STATEMENT

Many carbonated beverages are packaged in large containers having a screw cap engaged with a screw threaded neck. When the container is opened by unscrewing the cap to enable the contents of the container to be poured into a container for consumption, the carbonated beverage will become "flat" since the void space in the upper part of the beverage container enables the carbonation gas of the carbonated beverage to separate from the beverage and fill the void space even with the normally provided screw threaded cap being tightly replaced. Efforts have been made to overcome this problem by pressurizing the beverage container with such devices usually including a combination closure cap, pump and valve all of which remain with the beverage container thus requiring a pressurizing device for each beverage container from which contents are to be consumed. None of the prior patents known to applicant utilize the specific arrangement disclosed in this application. A separate information disclosure statement will be filed.

SUMMARY OF THE INVENTION

An object of the present invention is to provide a beverage container pressurizer including a replacement screw threaded closure cap having a valve structure associated therewith which replaces the conventional screw threaded cap once the beverage container has been opened by removing the normally provided screw threaded cap which can be discarded together with a manual pump detachably and sealingly connected to the valved screw threaded cap so that once the screw threaded cap has been placed on the beverage container, the pump may be assembled with the cap and the beverage container pressurized after which the pump is removed with the valved cap retaining the pressure in the beverage container thereby retaining the gas suspended in the beverage in the container rather than permitting the gas to separate from the beverage and fill the void space between the upper surface of the beverage and the inner surface of the beverage container.

Another object of the invention is to provide a beverage container pressurizer in accordance with the preceding object in which the manually operated pump is a piston and cylinder arrangement with the cylinder including an adapter on one end thereof for sealing engagement with the valved cap so that when the pump is placed on the cap, communication is provided between the interior of the pump cylinder and the valve in the screw threaded cap which will be automatically opened when the pressure within the pump cylinder exceeds the pressure in the beverage container.

A further object of the invention is to provide a beverage container pressurizer in accordance with the preceding objects in which the valve associated with the screw threaded cap is a one-way check valve inserted therein in sealed relation which allows repressurization of a bottle or other container for carbonated liquid, beverage or the like in order to retain the carbonation gas suspended in the liquid thereby preventing the liquid or beverage from going "flat" when less than all of the liquid or beverage is removed from the container and the replacement cap installed on the threaded neck of the container with the structure of the replacement threaded cap and the pump being relatively simple, easy to use and install and relatively inexpensive to manufacture.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
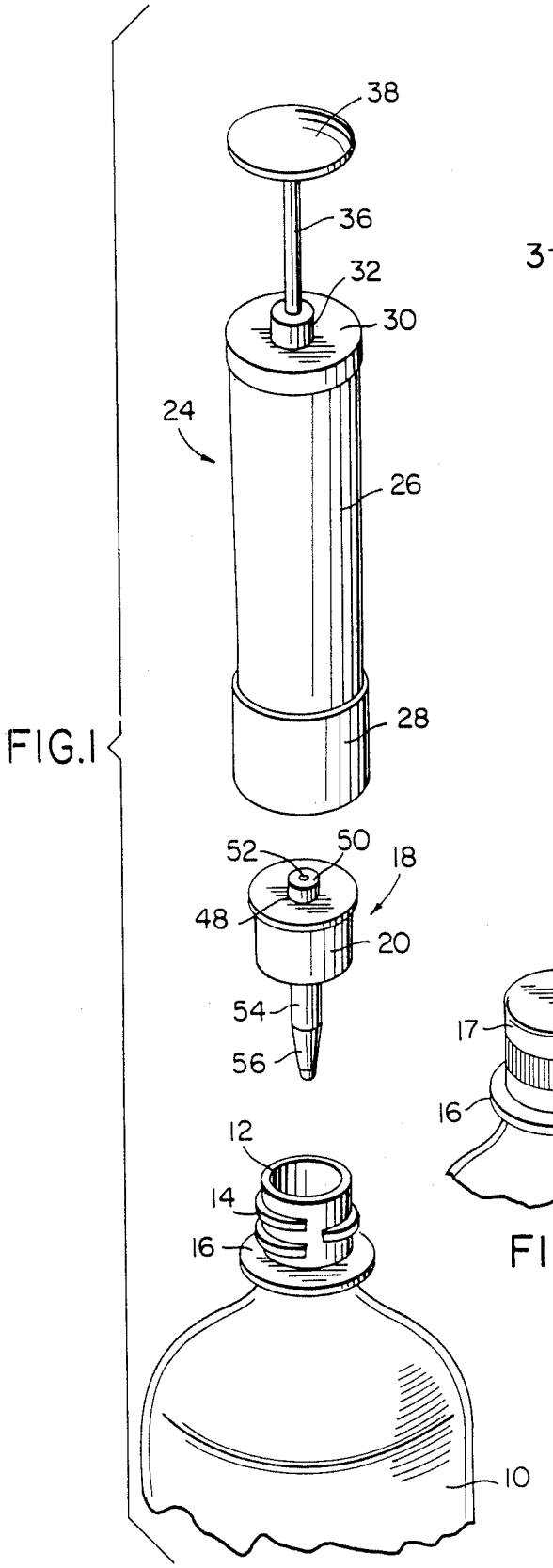
FIG. 1 is an exploded perspective view of the beverage container pressurizer of the present invention illustrating the association of the threaded neck of the beverage container, the replacement closure cap and the pump.
Figure 4:
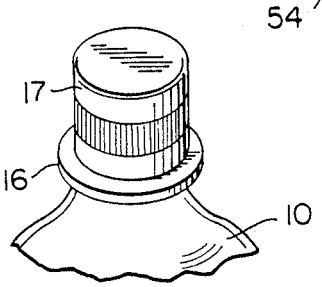
FIG. 4 is a fragmental perspective view of the beverage container with a screw cap in place.

Referring now specifically to the drawings, the beverage container pressurizer of the present invention is illustrated in FIG. 1 in association with a beverage container 10 of conventional construction having a neck 12 with external screw threads 14 and a flange 16 all of which represents conventional beverage container construction with the container 10 being completely conventional and constructed of plastic, glass or the like used in constructing beverage containers of this type. The capacity of the container may vary but the present invention has particular advantages in combination with a large beverage container such as a container having a capacity of 1 or 2 liters. The beverage container 10 is normally closed with a screw threaded closure cap 17 (see FIG. 4) which seals the container from the time it leaves the bottling plant until a consumer opens the container by unscrewing the cap. The conventionally provided screw threaded cap 17 for the container 10 will be discarded when removed and a replacement cap 18 forming a part of the present invention will be placed on the container 10 after a portion of the beverage or other carbonated liquid contents therein have been removed such as would conventionally occur when a beverage is poured from the container 10 into a smaller container for consumption. The cap 18 includes a hollow cylindrical body 20 having internal threads 22 which match with the threads 14 on the neck 12 so that when the replacement cap 18 is screw threaded onto the neck 12, it will form a sealed closure with respect to the neck 12 in the same manner that the original conventional closure cap formed a seal with the neck 12.

A manually operated pump generally designated by the numeral 24 forms the second component of the present invention and is associated with the cap 18 in a manner to enable the interior of the beverage container 10 to be repressurized, that is, the void space interiorly of the container 10 above the liquid level in the container 10 will be pressurized with air under pressure sufficient to retain the carbonation producing gas suspended in the liquid beverage thus preventing the carbonation gas from separating from the liquid which would result in the beverage becoming "flat" and less palatable.

The pump 24 includes a cylindrical pump body 26 having a smooth internal surface provided with a closure base 28 at one end and a closure cap 30 at the other end with the closure cap 30 including a boss 32 located centrally thereof which is provided with a passageway 34 receiving a piston rod 36 slidably therethrough with the outer end of the piston rod having a handle 38 in the form of a generally cylindrical knob or the like for reciprocating the piston rod 36. The end of the piston rod 36 which extends interiorly of the pump body 26 is provided with a piston 40 which reciprocates in the pump body 26 upon reciprocation of the piston rod 36 and handle 38 for pressurizing air within the cylinder and discharging it through the closure base 28.

Figure 2:
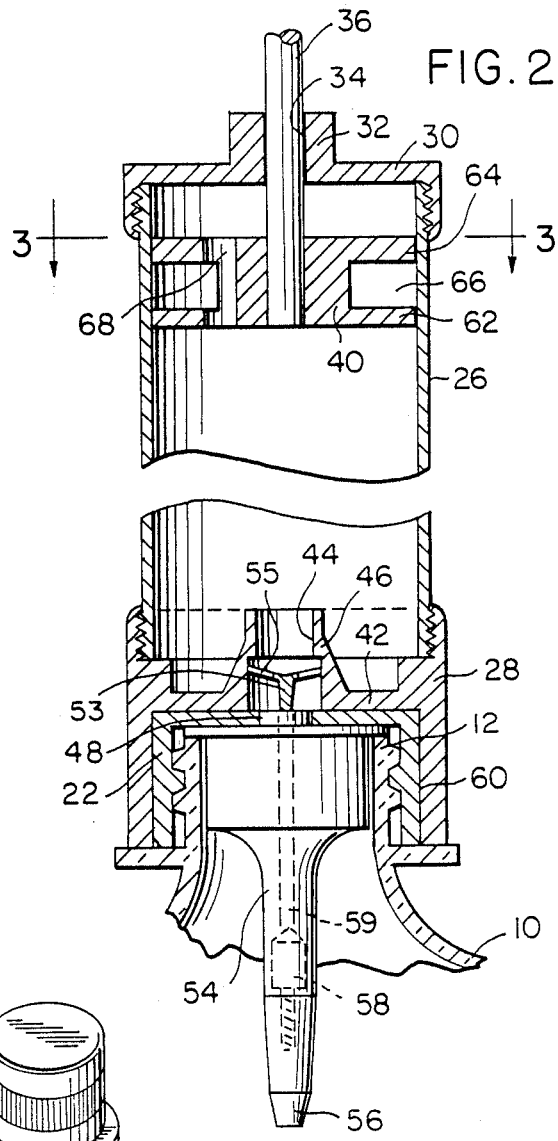
FIG. 2 is a vertical section view, on an enlarged scale, of the pump and illustrating the association of the lower end of the pump with the valved closure cap.

As illustrated in FIG. 2, the closure base 28 includes a transversely extending plate 42 having a passageway 44 centrally located therein with the passageway 44 being formed in an inwardly extending boss 46 with the outer end of the passageway 44 being enlarged at 48 as compared to the inner end thereof for telescopically receiving a cylindrical projection 50 extending outwardly of the closure cap 18 with the projection 50 also including a passageway 52 extending therethrough so that when the enlarged passageway 48 is telescoped over the projection 50, the interior of the pump body 26 will be communicated with the passageway 52 in the projection 50. The passageway 52 extends longitudinally through the projection 50 and through a depending projection 54 which is elongated and provided with a tapered lower end 56 which extends downwardly into the neck 12 of the bottle. A one-way check valve 58 is incorporated into the passageway 52 adjacent the lower end thereof which enables pressurized air to be pumped downwardly through the passageway 52 into the interior of the container 10 with the check valve 58 preventing pressurized air from exiting the container 10. The check valve 58 is conventional in and of itself and may be similar to a conventional Schraeder air valve which basically is a spring loaded check valve with the valve member being spring biased against a valve seat to prevent outflow but yet permitting inflow when the pressure at the outer end of the valve is greater than the pressure in the container and the valve is opened by a centrally disposed actuator 53 engaging the valve stem 59. The larger passageway 48 which is in the form of a cylindrical recess has the actuator 53 supported therein by a spider support 55 and is associated with the projection 50 in such a manner that a seal is formed therebetween when the pump 24 is positioned over the cap 18 so that the projection 50 telescopes into the passageway 48. To guide the pump 24 and retain it in alignment, the closure base 28 at the end of the pump which engages the cap 18 is provided with a cylindrical recess 60 that telescopes over and closely receives the exterior of the cap 18. The exterior of the closure cap 18 may be serrated to facilitate gripping engagement when assembling the cap 18 onto the container 10 and removing the cap 18 when it is desirable to remove the beverage from the container 10 such as by pouring into a smaller container or the like.

Figure 3:
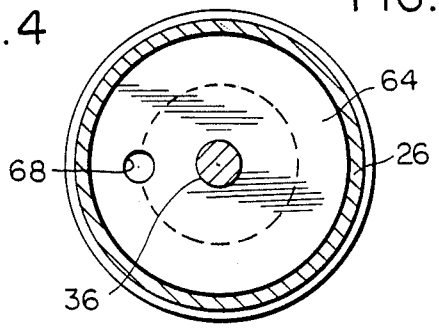
FIG. 3 is a transverse, sectional view taken substantially upon a plane passing along section line 3-3 on FIG. 2 illustrating specific structural details of the pump piston.

The piston 40 is in the form of a cylindrical member of substantially less diameter than the interior of the pump body 26 with the piston 40 including spaced flanges 62 and 64 which define an annular groove 66 around the periphery of the piston so that the periphery of the flanges 62 and 64 can sealingly and wipingly engage the interior of the pump body 26. The piston 40 also includes a passageway 68 extending through upper flange 64 with the passageway being located at the juncture of the flange 64 with the main portion of the piston 40 as illustrated in FIGS. 2 and 3. The various components of the device may be constructed of plastic material and assembled by screw threaded connections, bonding or the like with the piston flange 62 being sufficiently flexible to enable it to flex sufficiently to form a check valve to permit passage of air when moving outwardly and prevent passage of air when moving inwardly to pressurize air trapped within the body 26. The piston 40 will be retracted to its uppermost position as illustrated in FIG. 1 when the pump is engaged with the replacement cap 18 so that air can be pumped effectively into the interior of the container 10.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination, a carbonated beverage container having an externally screw threaded neck and a screw threaded closure cap which is removed and replaced each time that carbonated beverage is poured from the container which vents the pressure in the container above the liquid level of the beverage thereby permitting the beverage to become "flat" as the carbonating agent egresses from the beverage into the void space above the liquid level of the beverage in the container even when the closure cap is replaced, a screw threaded replacement cap sealingly mounted on the threaded neck of the container in place of the existing closure cap that has been removed, said replacement cap including a passageway having a one-way check valve therein to permit entry of air under pressure to pressurize the space in the container above the liquid level of the beverage thereby reducing egress of carbonating agent from the beverage into the space above the liquid level of the beverage, and a manually operated pump including means sealingly engaged with the passageway in the replacement cap for pressurizing the interior of the beverage container through the passageway in the replacement cap past the check valve therein, whereby the pump provides means to open the check valve said pump being separable from the replacement cap to enable the pump to be utilized with various beverage containers having replacement caps thereon.

2. The combination as defined in claim 1 wherein said pump is a reciprocating piston and cylinder pump having a cylindrical pump body with a closure member at each end thereof, one of the closure members including a piston rod connected with the piston and extending through the closure member and provided with a handle on the outer end thereof, the other closure member on the pump body including a passageway communicating with said passageway in the replacement cap having said check valve therein to enable passage of the pressurized air from the pump body into the interior of the beverage container.

3. The combination as defined in claim 3 wherein said replacement cap includes a cylindrical external peripheral surface and a centrally positioned outwardly extending cylindrical projection, said passageway in the replacement cap extending longitudinally through said projection, said replacement cap also including a centrally positioned inwardly extending projection extending into the neck of the container, said passageway in the replacement cap extending through the inwardly extending projection, said check valve being positioned in said inwardly extending projection and means spring biasing the check valve to closed position, said closure member on the pump body having the passageway therein including a cylindrical recess for telescopically receiving the replacement cap for guiding engagement between the pump and replacement cap, the central portion of said closure member on the pump body having the passageway therein including a recess telescopically receiving the outwardly extending projection on the replacement cap, said passageway in the closure member on the pump body being in communication with said centrally positioned recess in the closure member on the pump body.

* * * * *